US010830250B2

(12) United States Patent
Yu

(10) Patent No.: US 10,830,250 B2
(45) Date of Patent: Nov. 10, 2020

(54) WATER PUMP

(71) Applicant: Bingyan Yu, Chaozhou (CN)

(72) Inventor: Bingyan Yu, Chaozhou (CN)

(73) Assignee: Bingyan Yu, Chaozhou (CN)

( * ) Notice: Subject to any disclaimer, the term of this patent is extended or adjusted under 35 U.S.C. 154(b) by 151 days.

(21) Appl. No.: 16/098,566

(22) PCT Filed: Apr. 20, 2017

(86) PCT No.: PCT/CN2017/081269
§ 371 (c)(1),
(2) Date: Nov. 2, 2018

(87) PCT Pub. No.: WO2017/190592
PCT Pub. Date: Nov. 9, 2017

(65) Prior Publication Data

US 2019/0145426 A1 May 16, 2019

(30) Foreign Application Priority Data

May 5, 2016 (CN) ..... 2016 1 0292735
May 5, 2016 (CN) ..... 2016 2 0411352 U

(51) Int. Cl.
*F04D 29/42* (2006.01)
*F04D 29/60* (2006.01)

(52) U.S. Cl.
CPC ..... *F04D 29/4293* (2013.01); *F04D 29/60* (2013.01); *F04D 29/605* (2013.01); *F05B 2210/40* (2013.01); *F05B 2240/57* (2013.01)

(58) Field of Classification Search
CPC ..... F04D 29/605; F04D 29/606; F04D 29/628
See application file for complete search history.

(56) References Cited

U.S. PATENT DOCUMENTS 3,478,689 A * 11/1969 Ball ..... F04D 29/061 417/373
6,174,146 B1 * 1/2001 Lacy ..... F04D 15/0218 417/423.14
2009/0056123 A1 * 3/2009 Phillips ..... F04B 39/14 29/888

FOREIGN PATENT DOCUMENTS

CN 2694005 4/2005
CN 202091257 12/2011
CN 203685692 7/2014
(Continued)

OTHER PUBLICATIONS

Search Report issued to European counterpart Application No. 1792418.0 by the EPO dated Dec. 4, 2019.

*Primary Examiner* — Patrick Hamo
(74) *Attorney, Agent, or Firm* — McNees Wallace & Nurick LLC

(57) ABSTRACT

A water pump includes a pump body, a pump house with a water inlet and a water outlet, and a pump seat is provided. A circular mounting hole penetrating the pump seat is disposed in the pump seat, an annular mounting stage sheathed in the mounting hole is disposed at one end of the pump body, when the mounting stage disposed at one end of the pump body is inserted into the mounting hole, the pump body is configured to rotate around an axis of the mounting hole relative to the pump seat when the mounting stage disposed at the one end of the pump body is inserted into the mounting hole, and the pump house is disposed at one side of the pump seat away from the pump body and is connected with the pump body.

9 Claims, 4 Drawing Sheets

(56) References Cited

FOREIGN PATENT DOCUMENTS

| | | | | |
|---|---|---|---|---|
| CN | 204 458 309 | | 7/2015 | |
| CN | 105822600 | | 8/2016 | |
| CN | 205578357 | | 9/2016 | |
| JP | 2000345999 | | 12/2000 | |
| WO | WO-2016101805 | A1 * | 6/2016 | ..... F04B 53/00 |

* cited by examiner

WATER PUMP

CROSS-REFERENCES TO RELATED APPLICATIONS

This application is a national stage application under 35 U.S.C. 371 based on international patent application PCT/CN2017/081269, filed on Apr. 20, 2017 which claims priority to a Chinese patent application No. 201620411352.0 filed on May 5, 2016 and a Chinese patent application No. 201610292735.5 filed on May 5, 2016, disclosures of which are incorporated herein by reference in their entireties.

TECHNICAL FIELD

The present disclosure relates to the field of a water pump, and for example, to a water pump in which a direction of a water outlet may be adjusted, thereby facilitating the connection to a pipeline.

BACKGROUND

Water pumps are usually installed in aquariums, garden ponds or aquaculture ponds for filtering dirty objects such as fish excrement in such places so as to ensure basic water quality. For ease of installation and use, a mounting seat is usually configured to fix the water pump on the bottom of the pond or on a mounting bracket.

In the related art, the mounting seat is either integrated with the water pump or fixedly connected with the water pump via a screw bolt, so as to make the position of the mounting seat and the position of the water pump relatively fixed after installation. The direction of a water outlet of the water pump cannot be adjusted during use, which brings trouble to the installation of the pipeline. The pipeline is easily bent during the installation process. In view of this, it is necessary to use an elbows or a hose to change the direction of the water outlet. In such way, loss of water is increased, and equipment cost, operating cost, or both of the equipment cost and the operating cost may be increased.

SUMMARY

The present disclosure provides a water pump. The pump body of the water pump can rotate relative to a mounting seat, so that position and direction of a water outlet of the pump body can be adjusted during use, facilitating connection with a pipeline. The present disclosure provides a water pump which has a simple structure and is convenient for disassembling or assembling.

The water pump includes a pump body, a pump house with a water inlet and a water outlet, and a pump seat. A circular mounting hole penetrating the pump seat is disposed in the pump seat, an annular mounting stage sheathed in the mounting hole is disposed at one end of the pump body, the pump body is configured to rotate around an axis of the mounting hole relative to the pump seat when the mounting stage disposed at the one end of the pump body is inserted into the mounting hole, and the pump house is disposed at one side of the pump seat away from the pump body and is connected with the pump body. The water pump provided in the present disclosure disposes the mounting stage sheathed in the mounting hole on the pump seat on the pump body, so that the pump body can rotate relative to the pump seat and the position and direction of the water outlet can be adjusted during use, thereby facilitating the connection to the pipeline. The structure of the pump body and the pump seat is changed, simplifying the structure of the entire water pump and the disassembly and assembly of the pump body and the pump seat and reducing production and operating costs.

BRIEF DESCRIPTION OF DRAWINGS

In FIGS. 1 to 5:

Figure 1:
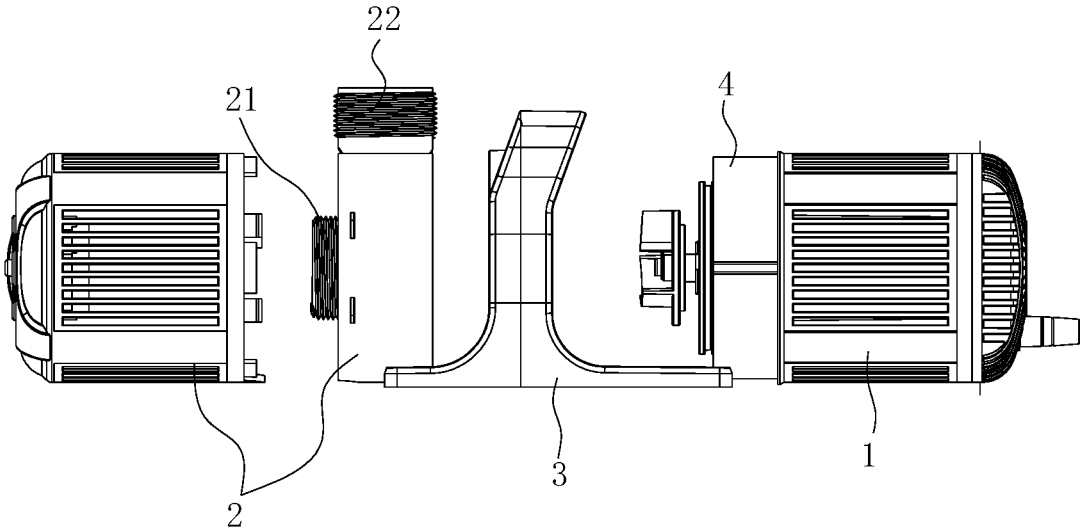
FIG. 1 is an exploded view of a water pump according to an embodiment.

1—pump body, 2—pump house, 21—water inlet, 22—water outlet, 3—pump seat, 31—mounting hole, 32—baffle plate, 33—stop protrusion, 34—stop screw, 35—first threaded hole, 36—stop threaded hole, 37—positioning slot, 38—positioning threaded hole, 39—positioning screw rod, 310—positioning nut, 4—mounting stage, 41—stop groove, 42—second threaded hole.

DETAILED DESCRIPTION

In the description of embodiments of the present disclosure, unless otherwise expressly specified and limited, the term "connected to each other", "connected" or "fixed" is to be construed in a broad sense, for example, as permanently connected, detachably connected, or integrated; mechanically connected or electrically connected; directly connected to each other or indirectly connected to each other via an intermediary; or internally connected or interactive between two components.

The solutions of the present disclosure are described hereinafter through specific embodiments in conjunction with the accompanying drawings. If not in collision, the following embodiments and the features thereof may be combined with each other.

As shown in FIGS. 1 to 5, the present disclosure provides a water pump, including a pump body 1, a pump house 2 with a water inlet 21 and a water outlet 22, and a pump seat 3. A circular mounting hole 31 penetrating the pump seat 3 is disposed in the pump seat 3, an annular mounting stage 4 sheathed in the mounting hole 31 is disposed at one end of the pump body 1, when the mounting stage 4 disposed at one end of the pump body 1 is inserted into the mounting hole 31, the pump body 1 can rotate around the axis of the mounting hole 31 relative to the pump seat 3, and the pump house 2 is disposed on one side of the pump seat 3 away from the pump body land is connected with the pump body 1. The pump body 1 can rotate relative to the pump seat 3, and position and direction of the water outlet 22 can be adjusted during use, thereby facilitating the connection between the water outlet 22 and a pipeline, by disposing the mounting stage 4 sheathed in the mounting hole 31 of the pump body 1. The structure of the pump body 1 and the pump seat 3 is changed, simplifying the structure of the entire water pump and the disassembly and assembly between the pump body 1 and the pump seat 3 and reducing production and operating costs.

In this embodiment, the pump house 2 is detachably connected with the pump body 1 via a screw.

Figure 2:
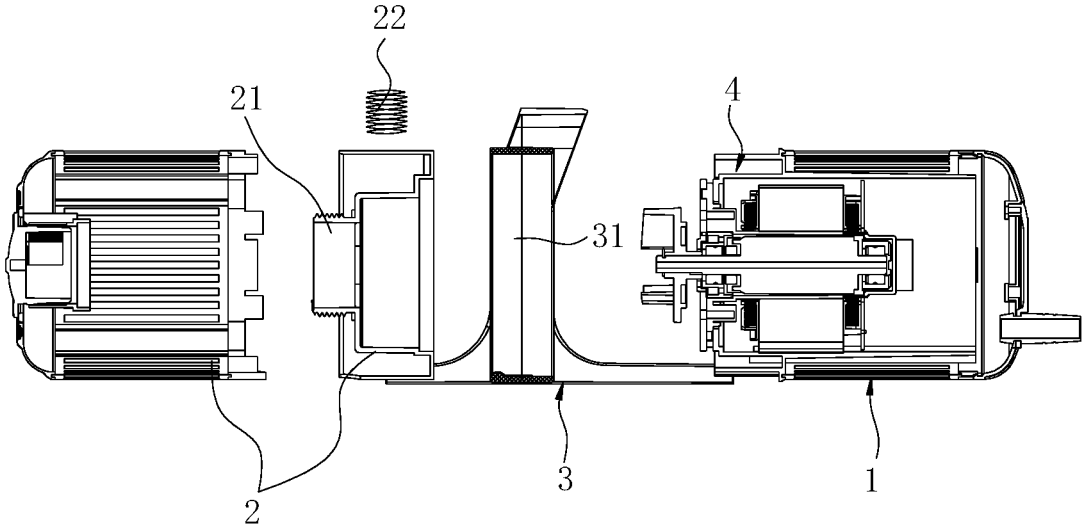
FIG. 2 is a section view of FIG. 1.

In an optional embodiment, as shown in FIG. 1 and FIG. 2, an outer diameter of the mounting stage 4 is less than a diameter of the pump body 1, that is, a stop surface is formed between the mounting stage 4 and the pump body 1. When the mounting stage 4 is inserted into the mounting hole 31 of the pump seat 3, the stop surface abuts against one end surface of the pump seat 3 closing to the pump body 1. The pump seat 3 can be sandwiched between the stop surface formed between the mounting stage 4 and the pump body 1 and the pump house 2 by making the outer diameter of the mounting stage 4 less than the diameter of the pump body 1.

Figure 3:
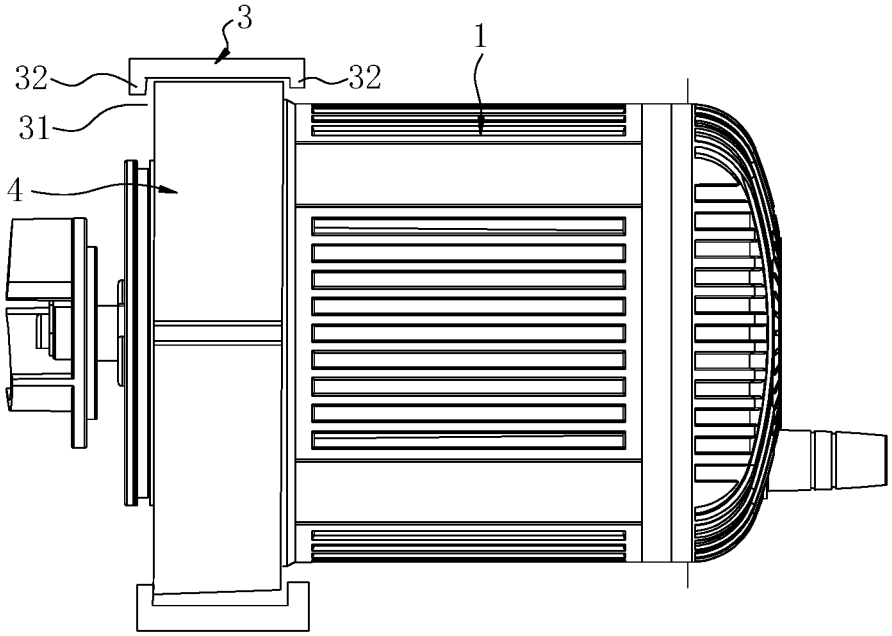
FIG. 3 is a structural diagram 1 of a water pump according to an embodiment (a pump house is not shown)

In an optional embodiment, as shown in FIG. 3, the outer diameter of the mounting stage 4 is greater than the diameter of the pump body 1, two annular baffle plates 32 are disposed on an inner wall of the mounting hole 31 in an axial direction of the mounting hole, an inner diameter of the two baffle plates 32 is less than the outer diameter of the mounting stage 4, and a spacing between the two baffle plates 32 is greater than a width of the mounting stage 4 in the axial direction. The outer diameter of the mounting stage 4 is configured to be greater than the diameter of the pump body 1 and a stop slot formed by two interval annular baffle plates 32 is correspondingly disposed on the inner wall of the mounting hole 31, so that when the mounting stage 4 is inserted into the mounting hole 31, the position of the mounting stage 4 is limited via the stop slot, thereby preventing the mounting stage 4 from moving in the axial direction.

In an embodiment, a stop component for limiting a rotation angle of the pump body 1 is further disposed between the mounting stage 4 and the pump seat 3.

Figure 4:
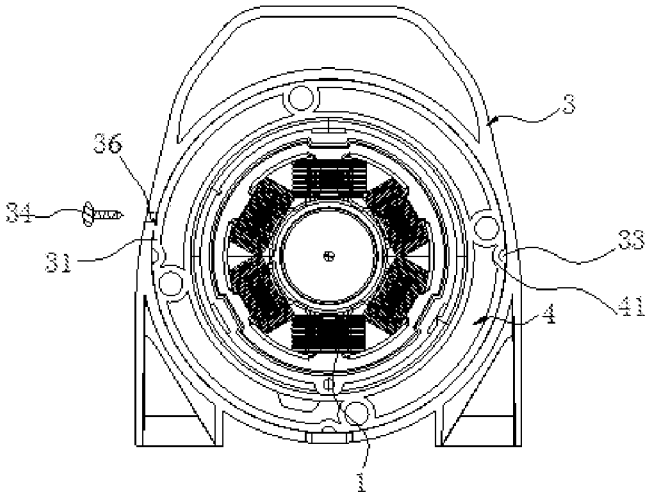
FIG. 4 is a structural diagram 2 of a water pump according to an embodiment (a pump house is not shown)

In an optional embodiment, the stop component includes one or more stop protrusions annularly disposed on the inner wall of the mounting hole 31 in a circumferential direction of the mounting hole 31, and at least one stop groove for clamping the one or more stop protrusions is disposed on an outer peripheral surface of the mounting stage. Referring to FIG. 4, the stop component includes three stop protrusions 33 annularly disposed on the inner wall of the mounting hole 31 in the circumferential direction of the mounting hole 31, and three stop grooves 41 capable of clamping the stop protrusions 33 are disposed on the outer peripheral surface of the mounting stage 4. When the mounting stage 4 is inserted into the mounting hole 31, the mounting stage 4 is tightly clamped in the stop protrusions 33 of the mounting hole 31 due to the pressing action. When the mounting stage 4 rotates to a certain angle, one of the stop protrusions 33 is clamped with the stop grooves 41 disposed on the outer peripheral surface of the mounting stage 4. At this time, due to the clamping action, the rotation of the mounting stage 4 is blocked, so that the pump body 1 cannot rotate freely relative to the pump seat 3, and the pump body 1 can be rotated when the angle of the mounting stage needs to be adjusted. The rotational force overcomes the frictional force between the mounting stage 4 and the stop protrusions 33 and the frictional force between the stop protrusions 33 and the stop grooves 41, so that the stop protrusions 33 are disengaged from the stop grooves 41, thereby achieving the adjustment of the angle of the mounting stage. When the mounting stage 4 is inserted into the mounting hole 31 by an external force, if the difference between the two is too great, the rotation of the pump body is difficult to achieve. If the diameter of the annular mounting surface formed by the one or more stop protrusions 33 is greater than the outer diameter of the mounting stage 4, the mounting stage 4 can rotate within the mounting hole 31, but the position of the mounting stage 4 and the pump seat 3 cannot be fixed at a specified angle after the mounting stage 4 rotates to the specified angle.

Optionally, the stop component includes one or more stop protrusions annularly disposed on the outer peripheral surface of the mounting stage 4 in the circumferential direction of the mounting stage 4, and at least one stop groove capable of clamping the stop protrusion is disposed in the mounting hole 31 in the circumferential direction of the mounting hole 31.

In an optional embodiment, as shown in FIG. 4, the stope component includes a stop screw 34 and a stop threaded hole 36 matched with the stop screw 34, at least one stop threaded hole 36 is provided in the pump seat 3, and the stop threaded hole 36 extends along a radial direction of the mounting hole 31 and is communicated with the mounting hole 31, a first end of the stop screw 34 is disposed outside the pump seat 3, and a second end of the stop screw 34 is screwed into the stop threaded hole 36 and selectively abuts against the outer peripheral surface of the mounting stage 4.

Figure 5:
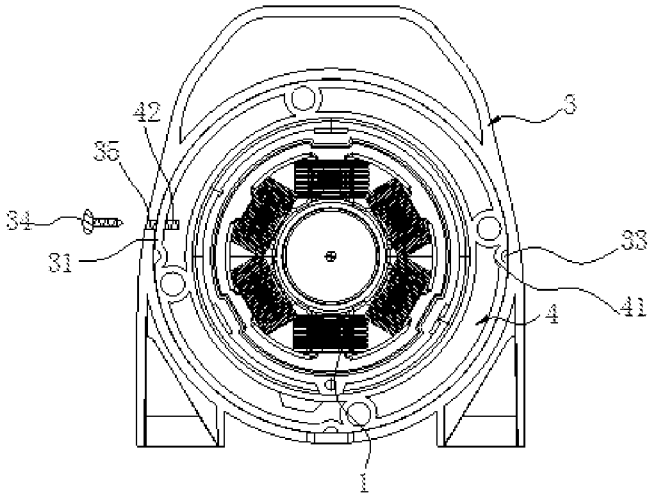
FIG. 5 is a side view of a water pump according to an embodiment (a pump house is not shown)
Figure 6:
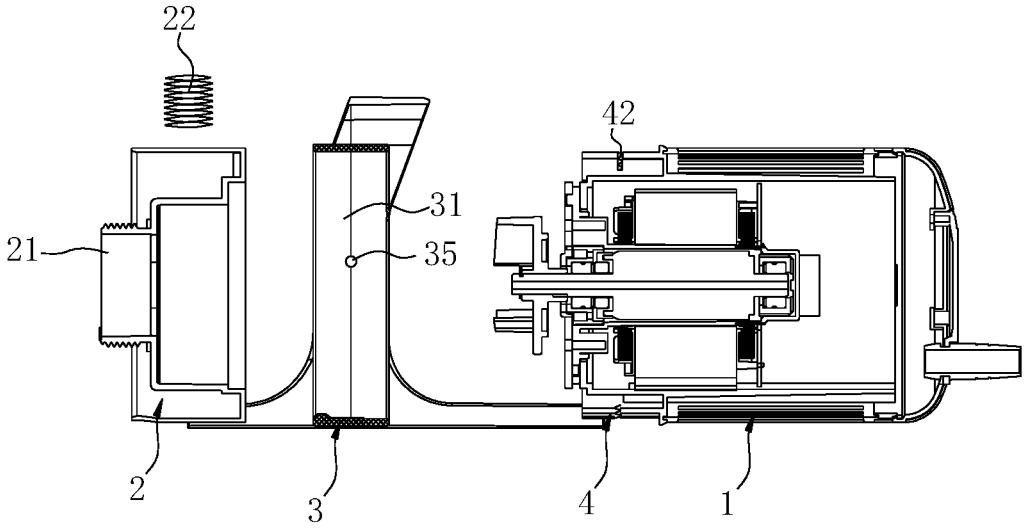
FIG. 6 is a structural diagram 3 of a water pump according to an embodiment.

In an optional embodiment, as shown in FIG. 5 and FIG. 6, the stop component includes a first threaded hole 35 disposed in the pump seat 3, where the first threaded hole 35 extends along the radial direction of the mounting hole 31 and is communicated with the mounting hole 31. A plurality of second threaded holes 42 corresponding to the first threaded hole 35 are annularly disposed in the outer periphery of the mounting stage 4. The stop component further includes a stop screw 34, where a first end of the stop screw 34 is disposed outside the pump seat 3, and a second end of the stop screw 34 passes through the first threaded hole 35 and is selectively screwed into one of the second threaded holes 42. By disposing the structure of the threaded hole and the stop screw 34, when the rotational position of the mounting stage 4 and the pump seat 3 is constant and the first threaded hole 35 faces to the second threaded holes 42, the relative position of the mounting stage 4 and the pump seat 3 may be fixed by making the stop screw 34 pass through the first threaded hole 35 and the second threaded holes 42. When the position of the water outlet 22 needs to be adjusted, it is merely needed to screw out the stop screw 34 and rotate the pump body 1, in order to make the mounting stage 4 and the pump seat 3 rotate relative to each other.

Figure 7:
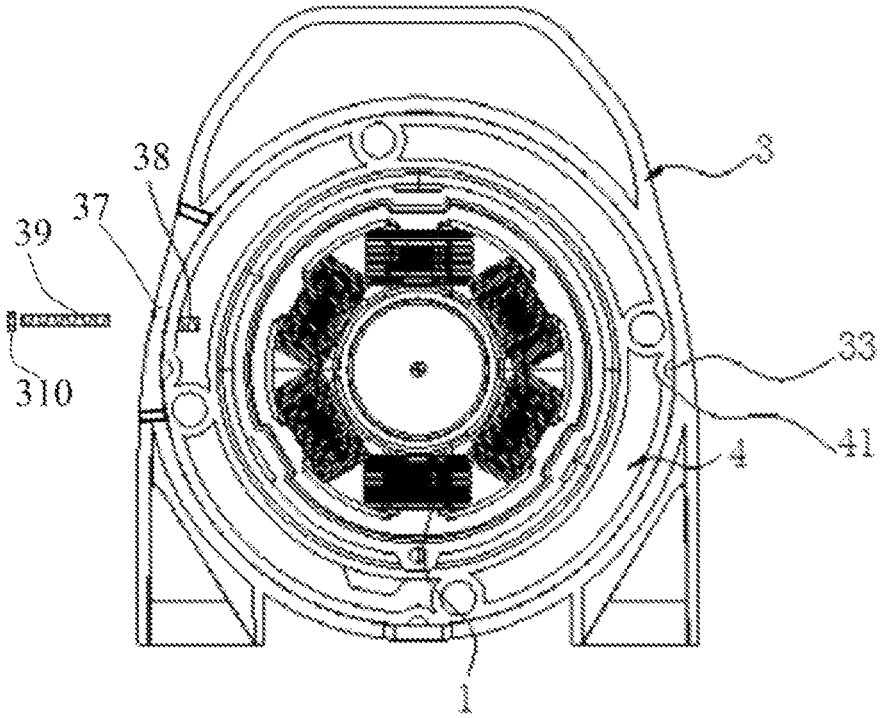
FIG. 7 is a structural diagram 4 of a water pump according to an embodiment.

In an optional embodiment, referring to FIG. 7, the stop component includes a positioning slot 37 annularly provided in the pump seat 3, the positioning slot 37 is communicated with the mounting hole 31, a positioning threaded hole 38 is disposed in the mounting stage 4, a positioning screw rod 39 is screwed in the positioning threaded hole 38, and one end of the positioning screw rod 39 away from the mounting stage 4 penetrates the positioning slot 37 and is screwed with a positioning nut 310 disposed on the pump seat 3. During installation, the mounting stage 4 at one end of the pump body 1 may be inserted into the mounting hole 31, the positioning screw rod 39 passes through screw threads of the positioning slot 37 on the pump seat 3 and is screwed into the positioning screw hole 38; and the pump body 1 is rotated, so that the mounting stage 4 and the pump seat 3 rotate relative to each other. When the rotation angle is a required angle, the positioning nut 310 is screwed on the positioning screw rod 39. The position of the pump seat 3 and the mounting stage 4 is fixed by using the clamping force between the positioning nut 310 and the positioning screw rod 39. When the position of the water outlet 22 needs to be adjusted again, the positioning nut 310 just needs to be loosened, so that the stop component between the pump seat 3 and the mounting stage 4 releases the stop operation and the pump body 1 can drive the mounting stage 4 to rotate relative to the pump seat 3 again.

Optionally, a diameter of the positioning screw rod is less than a width of the positioning slot in the axial direction of the mounting hole, and a width of the positioning nut is greater than the width of the positioning slot in the axis of the mounting hole. In the description of the present disclosure, terms "first" and "second" are for description only and are not to be construed as indicating or implying relative importance or implicitly indicating the number of technical features as indicated.

What is claimed is:

1. A water pump, comprising a pump body, a pump house with a water inlet and a water outlet, and a pump seat, wherein a circular mounting hole penetrating the pump seat is disposed in the pump seat, an annular mounting stage sheathed in the mounting hole is disposed at one end of the pump body, the pump body is configured to rotate around an axis of the mounting hole relative to the pump seat when the mounting stage disposed at the one end of the pump body is inserted into the mounting hole, and the pump house is disposed at one side of the pump seat away from the pump body and is connected with the pump body;

wherein the annular mounting stage sheathed in the mounting hole of the pump seat has an outer diameter greater than a diameter of the pump body, two annular baffle plates are disposed on an inner wall of the mounting hole along an axial direction of the mounting hole, an inner diameter of the two baffle plates is less than the outer diameter of the mounting stage, and a spacing between the two baffle plates is greater than a width of the mounting stage in the axial direction.

2. The water pump according to claim 1, wherein a stop component for limiting a rotation angle of the pump body is further disposed between the mounting stage and the pump seat.

3. The water pump according to claim 2, wherein the stop component comprises at least one stop protrusion annularly disposed on the inner wall of the mounting hole along a circumferential direction of the mounting hole, and at least one stop groove for clamping the at least one stop protrusion is disposed on an outer peripheral surface of the mounting stage.

4. The water pump according to claim 2, wherein the stop component comprises a stop screw and a stop threaded hole fitted with the stop screw, at least one stop threaded hole is provided in the pump seat, and the stop threaded hole extends along a radial direction of the mounting hole and is communicated with the mounting hole, a first end of the stop screw is disposed outside the pump seat, and a second end of the stop screw is screwed into the stop threaded hole and selectively abuts against the outer peripheral surface of the mounting stage.

5. The water pump according to claim 2, wherein the stop component comprises a stop screw and a first threaded hole disposed on the pump seat, the first threaded hole extends along a radial direction of the mounting hole and is communicated with the mounting hole, a plurality of second threaded holes corresponding to the first threaded hole are annularly disposed in an outer periphery of the mounting stage, a first end of the stop screw is disposed outside the pump seat, and a second end of the stop screw passes through the first threaded hole and is selectively screwed into one of the plurality of second threaded holes.

6. The water pump according to claim 2, wherein the stop component comprises a positioning slot annularly provided in the pump seat, the positioning slot is communicated with the mounting hole, a positioning threaded hole is disposed in the mounting stage, a positioning screw rod is screwed in the positioning threaded hole, and one end of the positioning screw rod away from the mounting stage penetrates the positioning slot and is screwed with a positioning nut disposed on the pump seat.

7. The water pump according to claim 6, wherein a diameter of the positioning screw rod is less than a width of the positioning slot in the axial direction of the mounting hole, and a width of the positioning nut is greater than the width of the positioning slot in the axis direction of the mounting hole.

8. The water pump according to claim 1, wherein the pump house is detachably connected with the pump body via a screw.

9. A water pump, comprising a pump body, a pump house with a water inlet and a water outlet, and a pump seat, wherein a circular mounting hole penetrating the pump seat is disposed in the pump seat, an annular mounting stage sheathed in the mounting hole is disposed at one end of the pump body, the pump body is configured to rotate around an axis of the mounting hole relative to the pump seat when the mounting stage disposed at the one end of the pump body is inserted into the mounting hole, and the pump house is disposed at one side of the pump seat away from the pump body and is connected with the pump body;

wherein an outer diameter of the mounting stage is less than a diameter of the pump body, a stop surface is provided between the mounting stage and the pump body, and the stop surface is configured to: in the case where the mounting stage is inserted into the mounting hole of the pump seat, abut against one end surface of the pump seat facing to the pump body.

* * * * *